US005541032A

United States Patent [19]

Oftring et al.

[11] Patent Number: 5,541,032

[45] Date of Patent: Jul. 30, 1996

[54] ELECTROSTATIC TONERS CONTAINING PHENACYL COMPOUNDS

[75] Inventors: Alfred Oftring, Bad Dürkheim; Bernd Burkhart, Mutterstadt; Thomas Wehlage, Hamburg; Rainer Dyllick-Brenzinger, Weinheim; Karin H. Beck, Ludwigshafen, all of Germany

[73] Assignee: BASF Aktiengesellschaft, Ludwigshafen, Germany

[21] Appl. No.: 432,064

[22] Filed: May 1, 1995

[30] Foreign Application Priority Data

May 7, 1994 [DE] Germany ..... 44 16 265.0

[51] Int. Cl.[6] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 4,265,990 | 5/1981 | Stolka et al. | 430/59 |
| 5,102,765 | 4/1992 | McCabe et al. | 430/110 |
| 5,147,749 | 9/1992 | Alexandrovich et al. | 430/110 |

FOREIGN PATENT DOCUMENTS

| | | | |
|---|---|---|---|
| 0382285 | 8/1990 | European Pat. Off. . | |
| 166359 | 7/1987 | Japan | 430/110 |
| 93/02397 | 2/1993 | WIPO . | |
| 93/02400 | 2/1993 | WIPO . | |
| 93/02053 | 2/1993 | WIPO . | |
| 93/02054 | 2/1993 | WIPO . | |

*Primary Examiner*—Roland Martin

*Attorney, Agent, or Firm*—Oblon, Spivak, McClelland, Maier & Neustadt, P.C.

[57] ABSTRACT

Electrostatic toners contain a polymeric binder and, as a charge stabilizer, a compound of the formula

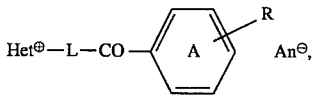

where the ring A may be benzofused and

Het⊕ is the positively charged radical of a heterocycle,

L is C–$C_8$-alkylene,

R is hydrogen, unsubstituted or substituted $C_{1-C6}$-alkyl, unsubstituted or substituted phenyl, unsubstituted or substituted hydroxyl or unsubstituted or substituted amino and An⊖ is one equivalent of an anion.

10 Claims, No Drawings

ELECTROSTATIC TONERS CONTAINING PHENACYL COMPOUNDS

The present invention relates to novel electrostatic toners containing a polymeric binder and, as a charge stabilizer, a compound of the formula I

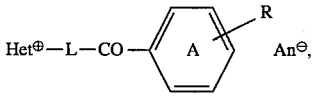

(I)

where the ring A may be benzofused and

Het⊕ is the positively charged radical of a heterocycle which originates from the pyrazole, imidazole, pyridine, quinoline or isoquinoline series, L is $C_1$–$C_8$-alkylene, R is hydrogen, unsubstituted or substituted $C_1$–$C_6$-alkyl, unsubstituted or substituted phenyl, hydroxyl, $C_1$–$C_4$-alkoxy, unsubstituted or substituted phenoxy, amino, $C_1$–$C_4$-mono- or dialkylamino, unsubstituted or substituted mono- or diphenylamino or unsubstituted or substituted N- ($C_1$–$C_4$-alkyl) -N-phenylamino and An⊖ is one equivalent of an anion, and the use of the abovementioned compounds as charge stabilizers in electrostatic toners.

Latent electrostatic image recordings are developed by inductively depositing the toner on the electrostatic image. The charge stabilizers stabilize the electrostatic charge of the toner. This makes the image stronger and crisper.

The charge stabilizers used must meet a wide range of requirements:

ability to develop the latent electrostatic image to give a visible image of high color intensity easy distribution in the toner formulation in order to produce an interference-free, crisp, uniform image insensitivity to moisture high heat stability.

WO-A-93/02397, WO-A-93/02400, WO-A-93/02053 and WO-A-93/02054 disclose electrostatic toners which contain, as charge stabilizers, pyridinium salts containing ester groups, such as N-(ethoxycarbonylmethyl)pyridinium tetraphenylborate or N-(2-benzoyloxyethyl)pyridinium tetraphenylborate.

However, it has been found that the prior art charge stabilizers frequently failed to meet the requirements.

It is an object of the present invention to provide a novel electrostatic toner which possesses charge stabilizers which have advantageous performance characteristics.

We have found that this object is achieved by the electrostatic toners defined at the outset, containing phenacyl derivatives of the formula I as charge stabilizers.

All alkyl and alkylene groups occurring in the abovementioned formula I may be either straight-chain or branched.

If substituted alkyl groups occur in the abovementioned formula I, suitable substituents are, for example, hydroxyl, $C_1$–$C_4$-alkoxy, carboxyl or $C_1$–$C_4$-alkoxycarbonyl. In this case, the alkyl groups have, as a rule, 1 or 2 substituents.

If substituted phenyl groups occur in the abovementioned formula I, suitable substituents are, for example, $C_1$–$C_4$-alkyl, $C_1$–$C_4$-alkoxy, halogen or hydroxyl. In this case, the phenyl groups have, as a rule, from 1 to 3 substituents.

Suitable heterocycles Het on which the radical Het⊕ are based originate from the pyrazole, imidazole, pyridine, quinoline or isoquinoline series.

They include, for example, the following structures:

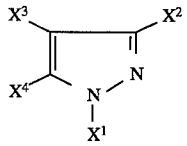

(IIa)

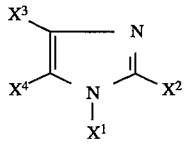

(IIb)

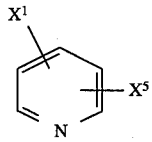

(IIc)

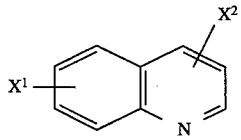

(IId)

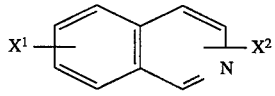

(IIe)

where $X^1$, $X^2$ $X^3$ and $X^4$ independently of one another are each hydrogen or $C_1$–$C_6$-alkyl and $X^5$ is hydrogen, carboxyl, carbamoyl or $C_1$–$C_4$-alkoxycarbonyl.

R, $X^1$, $X^2$, $X^3$ and $X^4$ are, for example, methyl, ethyl, propyl, isopropyl, butyl, isobutyl, sec-butyl, tert-butyl, pentyl, isopentyl, neopentyl, tert-pentyl, hexyl or 2-methylpentyl.

R may furthermore be, for example, carboxymethyl, 2-carboxyethyl, 2- or 3-carboxypropyl, 2- or 4-carboxybutyl, 2-hydroxyethyl, 2-or 3-hydroxypropyl, 2- or 4-hydroxybutyl, 2-methoxyethyl, 2-ethoxyethyl, 2-propoxyethyl, 2-isopropoxyethyl, 2-butoxyethyl, 2-or 3-methoxypropyl, 2- or 3-ethoxypropyl, 2- or 3-propoxypropyl, 2- or 3-butoxypropyl, 2- or 4-methoxybutyl, 2- or 4-ethoxybutyl, 2- or 4-propoxybutyl, 2- or 4-butoxybutyl, methoxycarbonylmethyl, ethoxycarbonylmethyl, 2-methoxycarbonylethyl, 2-ethoxycarbonyl-ethyl, 2- or 3-methoxycarbonylpropyl, 2- or 3-ethoxycarbonyl-propyl, 2- or 4-methoxycarbonylbutyl, 2- or 4-ethoxycarbonyl-butyl, 2-, 3- or 4-methylphenyl, 2,4-dimethylphenyl, 2-, 3- or 4-methoxyphenyl, 2,4-dimethoxyphenyl, 2-, 3- or 4-hydroxyphenyl, 2,4-dihydroxyphenyl, 2-, 3- or 4-chlorophenyl, 2,4-dichlorophenyl methoxy, ethoxy, propoxy, isopropoxy, butoxy, isobutoxy, sec-butoxy, phenoxy, 2-, 3- or 4-methylphenoxy, 2,4-dimethylphenoxy, 2-, 3- or 4-methoxyphenoxy, 2,4-dimethoxyphenoxy, 2-, 3- or 4-hydroxyphenoxy, 2,4-dihydroxyphenoxy, 2-, 3-or 4-chlorophenoxy, 2,4-dichlorophenoxy, mono- or dimethylamino, mono- or diethylamino, mono- or dipropylamino, mono- or diisopropylamino, mono- or dibutylamino, mono- or diphenylamino, mono- or bis(4-chlorophenyl)amino or N-methyl-N-phenylamino. $X^5$ may furthermore be, for example, methoxycarbonyl, ethoxycarbonyl, propoxycarbonyl, isopropoxycarbonyl or butoxycarbonyl.

L is, for example, $CH_2$, $(CH_2)_2$, $(CH_2)_3$, $(CH_2)_4$, $(CH_2)_5$, $(CH_2)_6$, $(CH_2)_7$, $(CH_2)_8$, $CH(CH_3)CH_2$ or $CH(CH_3)CH(CH_3)$.

Suitable anions on which one equivalent of an anion (An⊖) is based are, for example, inorganic or organic anions, such as halide, for example fluorine, chloride, bromide or iodide, sulfate, bisulfate, methanesulfonate, trifluoromethanesulfonate, 2-hydroxyethanesulfonate, tetraphenylborate, tetrafluoroborate, p-toluenesulfonate, nitrate, perchlorate, 1-hydroxyethane-1,1-diphosphonate, phosphate, hydrogen phosphate, dihydrogen phosphate, formate, acetate, oxalate, citrate or tartrate.

An anion which may be mentioned in particular is tetrafluoroborate.

Electrostatic toners containing a compound of the formula I where Het⊕ is derived from a heterocycle from the pyridine series, in particular from a pyridine of the formula IIc, are preferred.

Electrostatic toners containing a compound of the formula I where L is $C_1$–$C_6$-alkylene, in particular $C_1$–$C_2$-alkylene, are also preferred.

Electrostatic toners containing a compound of the formula I where the ring A is not benzofused and R is hydrogen, $C_1$–$C_4$-alkyl, $C_1$–$C_4$-alkoxy or phenyl are furthermore preferred.

Particular important electrostatic toners are those containing a compound of the formula I where Het⊕ is a radical of the formula IIf.

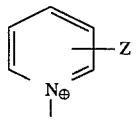

(IIf)

where Z is hydrogen, methyl, carboxyl or $C_1$–$C_4$-alkoxycarbonyl, especially hydrogen.

The phenacyl compounds of the formula I are as a rule compounds which are known or which can be obtained by methods known per se.

For example, a ketone of the formula III

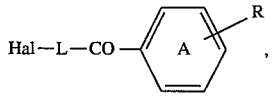

(III)

where Hal is halogen, preferably chlorine or bromine, and L, R and the ring A each have the abovementioned meanings, can be reacted with a heterocycle of the formula IV Het (IV), where Het has the abovementioned meanings. A compound of the formula I where An⊖ is halide is obtained in this manner.

The reaction of the components III and IV is advantageously carried out in an inert solvent, such as toluene, xylene, petroleum ether, naphtha, cyclohexane, acetone, tetrahydrofuran, dioxane, methanol, ethanol, isopropanol, methyl or ethyl acetate or acetonitrile. As a rule, the reaction is carried out at from 40° to 130° C., preferably from 60° to 100° C., and under atmospheric pressure.

By subjecting these compounds to double decomposition with salts of the formula V M⊕ An⊖ (V), where M⊕ is one equivalent of a metal ion, in particular an alkali metal ion, and An⊖ has the abovementioned meanings (with the exception of halide), in an aqueous medium, it is possible to obtain, for example, those compounds of the formula I in which An⊖ differs from halide. Further details are also given in the examples.

The amount of the compounds of the formula I in the electrostatic toner is, as a rule, from 0.01 to 10% by weight, based on the weight of the toner.

The polymeric binders present in the novel electrostatic toners are known per se. They are as a rule thermoplastic and have a softening point of from 40° to 200° C., preferably from 50° to 130° C., in particular from 65° to 115° C. Examples of polymeric binders are polystyrene, copolymers of styrene with an acrylate or methacrylate, copolymers of styrene with butadiene and/or acrylonitrile, polyacrylates, polymethacrylates, copolymers of an acrylate or methacrylate with vinyl chloride or vinyl acetate, polyvinyl chloride, copolymers of vinyl chloride with vinylidene chloride, copolymers of vinyl chloride with vinyl acetate, polyester resins, epoxy resins, polyamides or polyurethanes.

In addition to the abovementioned compounds of the formula I and the polymeric binders, the novel toners may contain known amounts of colorants, magnetic material, waxes and fluxes.

The colorants may be organic dyes or pigments, such as nigrosine, aniline blue, 2,9-dimethylquinacridone, C.I. Disperse Red 15 (C.I. 6010), C.I. Solvent Red 19 (C.I. 26 050), C.I. Pigment Blue 15 (C.I. 74 160), C.I. Pigment Blue 22 (C.I. 69 810) or C.I. Solvent Yellow 16 (C.I. 12 700), or inorganic pigments, such as carbon black, red lead, yellow lead oxide or chrome yellow. In general, the amount of the colorant present in the toner does not exceed 15% by weight, based on the weight of the toner.

The magnetic material may be, for example, iron, nickel, chromium oxide, iron oxide or a ferrite of the formula $MeFe_2O_4$, where Me is a divalent metal, eg. iron, cobalt, zinc, nickel or manganese.

The novel toners are prepared by conventional processes, for example by mixing the components in a kneader and then powdering the mixture or by melting the polymeric binder or a mixture of the polymeric binders, then finely dispersing one or more compounds of the formula I and the other additives, if used, in the molten resin using the mixing and kneading apparatuses known for this purpose, then cooling the melt to give a solid material and finally milling the solid material to give particles of the desired size (as a rule from 0.1 to 50 μm). It is also possible to dissolve the polymeric binder and the charge stabilizer in a common solvent and to add the other additives to the solution. The solution can therefore be used as a liquid toner.

However, the liquid may also be spray-dried in a manner known per se, the solvents can be evaporated off or the liquid can be freeze-dried and the solid residue milled to give particles of the desired size.

It is also possible for the compounds of the formula I which are used as charge stabilizers to be finely dispersed in the solution of the polymeric binder instead of dissolving them. The resulting toner formulation can then be used, for example according to U. S. Pat. No. 4,265,990, in a xerographic image recording system.

The abovementioned compounds of the formula I are advantageous charge stabilizers. As a rule, they have the performance characteristics required at the outset and in particular, when added to a toner preparation, impart to the latter an advantageous electrostatic charging profile, ie. the toners can be rapidly charged to a high charge. The charge stabilizers to be used according to the invention furthermore ensure that the charge is kept constant at a high level.

The examples which follow illustrate the invention.

A) Preparation of the phenacyl compounds

EXAMPLE H1

Preparation of 4-methylphenacylpyridinium bromide 64 g (0.3 mol) of 4-methylphenacyl bromide in 80 ml acetone were initially taken and heated to 60° C. 24 g (0.3 mol) of pyridine were then slowly added dropwise. The reaction mixture was stirred for a further hour at 60° C. and cooled to room temperature. The precipitated solid was filtered off and washed with acetone. After drying, 82.5 g (corresponding to a yield of 94%) of the title compound were obtained in the form of a yellow powder. The purity of the product was more than 99%.

EXAMPLE H2

Preparation of 4-methylphenacylpyridinium tetrafluoroborate 30 g (0.1 mol) of 4-methylphenacylpyridinium bromide in 120 ml of water were initially taken and heated to 60° C. 11 g (0.1 mol) of sodium tetrafluoroborate were then added and the mixture was slowly cooled to room temperature. It was stirred for a further hour at room temperature, and the precipitated product was filtered off and washed with water. After drying, 22.2 g (corresponding to a yield of 74%) of the title compound were obtained in the form of a yellow solid. The purity of the product was more than 99%.

EXAMPLE H3

Preparation of 4-methylphenacylpyridinium tetraphenylborate

The title compound was prepared similarly to Example 2 from 4-methylphenacylpyridinium bromide and sodium tetraphenylborate in a yield of 100%.

EXAMPLE H4

Preparation of 4-methoxyphenacylpyridinium bromide

The title compound was prepared similarly to Example 1 from 4-methoxyphenacyl bromide and pyridine in a yield of 97%.

EXAMPLE H5

Preparation of 4-methoxyphenacylpyridinium tetrafluoroborate

The title compound was prepared similarly to Example 2 from 4-methoxyphenacylpyridinium bromide and sodium tetrafluoroborate in a yield of 85%.

EXAMPLE H6

Preparation of 4-methoxyphenacylpyridinium tetraphenylborate

The title compound was prepared similarly to Example 2 from 4-methoxyphenacylpyridinium bromide and sodium tetraphenylborate in a yield of 100%.

EXAMPLE H7

Preparation of 3-methoxyphenacylpyridinium chloride

The title compound was prepared similarly to Example 1 from 3-methoxyphenacyl chloride and pyridine in a yield of 93%.

EXAMPLE H8

Preparation of naphthacylpyridinium bromide

The title compound was prepared similarly to Example 1 from ω-bromo-2-acetonaphthone and pyridine in a yield of 96%.

EXAMPLE H9

Preparation of 4-tert-butylphenacylpyridinium chloride

The title compound was prepared similarly to Example 1 from 4-tert-butylphenacyl chloride and pyridine in a yield of 94%.

EXAMPLE H10

Preparation of 4-isopropylphenacylpyridinium chloride

The title compound was prepared similarly to Example 1 from 4-isopropylphenacyl chloride and pyridine in a yield of 93%.

EXAMPLE H11

Preparation of 4-phenylphenacylpyridinium bromide

The title compound was prepared similarly to Example 1 from 4-phenylphenacyl bromide and pyridine in a yield of 95%.

B) Use

The use examples were carried out using colorant-free toner models consisting of resin and the novel charge stabilizers.

I. Preparation of the toners

EXAMPLE A1

0.2 g of the compound from Example H1 was introduced into a solution of 10 g of a uncrosslinked styrene/butyl acrylate resin in 100 ml of p-xylene at room temperature and the mixture was then freeze-dried and milled. Toner particles having a mean particle size of 50 μm were obtained by classification.

EXAMPLE A2

10 g of a uncrosslinked styrene/butyl acrylate resin and 0.2 g of the compound from Example H1 were thoroughly mixed in a mixer, kneaded at 120° C., extruded and milled. Toner particles having a mean particle size of 50 μm were obtained by classification.

EXAMPLE A3

0.2 g of the compound from Example H2 was introduced into a solution of 10 g of a linear polyester resin in 100 ml of p-xylene at room temperature and the mixture was then freeze-dried and milled. Toner particles having a mean particle size of 50 μm were obtained by classification.

EXAMPLE A4

10 g of a linear, uncrosslinked polyester resin and 0.2 g of the compound from Example H2 were thoroughly mixed in a mixer, kneaded at 120° C., extruded and milled. Toner particles having a mean particle size of 50 μm were obtained by classification.

EXAMPLE A5

10 g of a linear, uncrosslinked polyester resin and 0.2 g of the compound from Example H3 were thoroughly mixed in a mixer, kneaded at 120° C., extruded and milled. Toner particles having a mean particle size of 50 μm were obtained by classification.

EXAMPLE A6

0.2 g of the compound from Example H5 was introduced into a solution of 10 g of a linear polyester resin in 100 ml of p-xylene at room temperature and the mixture was then freeze-dried and milled. Toner particles having a mean particle size of 50 μm were obtained by classification.

EXAMPLE A7

10 g of a linear, uncrosslinked polyester resin and 0.2 g of the compound from Example H5 were thoroughly mixed in a mixer, kneaded at 120° C., extruded and milled. Toner particles having a mean particle size of 50 μm were obtained by classification.

EXAMPLE A8

10 g of a linear, uncrosslinked polyester resin and 0.2 g of the compound from Example H6 were thoroughly mixed in a mixer, kneaded at 120° C., extruded and milled. Toner particles having a mean particle size of 50 μm were obtained by classification.

EXAMPLE A9

0.2 g of the compound from Example H7 was introduced into a solution of 10 g of an uncrosslinked styrene/butyl acrylate resin in 100 ml of p-xylene at room temperature and the mixture was then freeze-dried and milled. Toner particles having a mean particle size of 50 μm were obtained by classification.

EXAMPLE A10

0.2 g of the compound from Example H8 was introduced into a solution of 10 g of an uncrosslinked styrene/butyl acrylate resin in 100 ml of p-xylene at room temperature and the mixture was then freeze-dried and milled. Toner particles having a mean particle size of 50 μm were obtained by classification.

EXAMPLE A11

0.2 g of the compound from Example H9 was introduced into a solution of 10 g of an uncrosslinked styrene/butyl acrylate resin in 100 ml of p-xylene at room temperature and the mixture was then freeze-dried and milled. Toner particles having a mean particle size of 50 μm were obtained by classification.

EXAMPLE A12

0.2 g of the compound from Example H10 was introduced into a solution of 10 g of an uncrosslinked styrene/butyl acrylate resin in 100 ml of p-xylene at room temperature and the mixture was then freeze-dried and milled. Toner particles having a mean particle size of 50 μm were obtained by classification.

EXAMPLE A13

0.2 g of the compound from Example H11 was introduced into a solution of 10 g of an uncrosslinked styrene/butyl acrylate resin in 100 ml of p-xylene at room temperature and the mixture was then freeze-dried and milled. Toner particles having a mean particle size of 50 μm were obtained by classification.

II. Preparation of the developers and testing

For the preparation of a developer, 99% by weight of a steel carrier which had a mean particle size of 100 μm and 1% by weight of the toner were accurately weighed in and were activated on a roller stand for a period defined below. The electrostatic charge build-up on the developer was then determined. In a commercial q/m meter (from Epping GmbH, Neufahrn), about 5 g of the activated developer were introduced into a hard-blow-off cell electrically connected to an electrometer. The mesh size of the sieves used in the measuring cell were 63 μm.

This ensured that the toner was blown off as completely as possible but the carrier remained in the measuring cell. By means of a strong air current (about 4,000 $cm^3$/min) and simultaneous suction, the toner was virtually completely removed from the carrier particles, the latter remaining in the measuring cell. The charge build-up on the carrier was recorded on the electrometer. It corresponded to the magnitude of the charge build-up on the toner particles, but with the opposite sign. The magnitude of q with the opposite sign was therefore used for calculating the q/m value. By reweighing the measuring cell, the mass of blown-off toner was determined and the electrostatic charge build-up q/m was calculated from this.

The charge build-up determined for the toners is summarized in the table below.

TABLE

| Example No. | Compound from Example | Preparation of the toner* | Charge build-up after activation for 10 min [μC/g] | 30 min | 60 min | 120 min |
|---|---|---|---|---|---|---|
| A1 | H1 | F | 6.8 | 5.5 | 5.1 | 4.2 |
| A2 | H1 | K | 4.2 | 2.9 | 2.6 | 2.8 |
| A3 | H2 | F | 20.6 | 22.7 | 24.7 | 24.0 |
| A4 | H2 | K | 7.5 | 7.1 | 7.6 | 7.6 |
| A5 | H3 | K | 11.6 | 13.6 | 12.9 | 12.1 |
| A6 | H5 | F | 24.5 | 24.3 | 25.7 | 24.7 |
| A7 | H5 | K | 10.5 | 11.2 | 10.5 | 11.5 |
| A8 | H6 | K | 13.7 | 13.7 | 13.6 | 1.6 |
| A9 | H7 | F | 9.3 | 7.0 | 6.6 | 6.2 |
| A10 | H8 | F | 6.7 | 5.1 | 4.4 | 3.8 |
| A11 | H9 | F | 1.8 | 1.7 | 1.5 | 1.4 |
| A12 | H10 | F | 1.9 | 2.2 | 1.8 | 1.8 |
| A13 | H11 | F | 6.7 | 4.6 | 3.1 | 2.2 |

*The toner was prepared either by freeze-drying according to Example A1 (denoted by F in the table) or by kneading at above the softening point of the resin according to Example A2 (denoted by K in the table).

We claim:

1. An electrostatic toner containing a polymeric binder and, as a charge stabilizer, a compound of formula I:

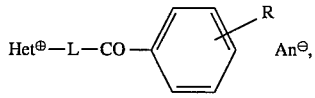

(I)

wherein ring A may be benzofused and

Het⊕ is the positively charged radical of a heterocyclic group selected from the group consisting of pyrazolyl, imidazolyl, pyridyl, quinolyl and isoquinolyl;

L is $C_1$–$C_8$ -alkylene;

R is hydrogen, unsubstituted or substituted $C_1$–$C_6$-alkyl, unsubstituted or substituted phenyl, hydroxyl, $C_1$–$C_4$-alkoxy, unsubstituted or substituted phenoxy, amino, $C_1$–$C_4$-mono- or dialkylamino, unsubstituted or substituted mono- or diphenylamino or unsubstituted or substituted N-($C_1$–$C_4$-alkyl)-N-phenylamino and An⊖ is one equivalent of an anion.

2. The electrostatic toner as claimed in claim 1, wherein said Het⊕ is a pyridyl group.

3. The electrostatic toner as claimed in claim 1, wherein substituent L is $C_1$–$C_4$-alkylene.

4. The electrostatic toner as claimed in claim 1, wherein ring A is not benzofused and R is hydrogen, $C_1$–$C_4$- alkyl, $C_1$–$C_4$-alkoxy or phenyl.

5. The electrostatic toner as claimed in claim 1, wherein said Het⊕ is a radical of the formula:

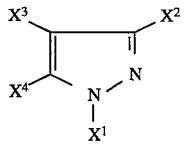
(IIa)

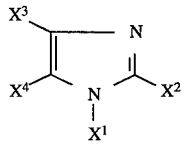
(IIb)

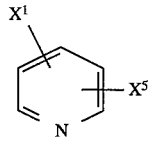
(IIc)

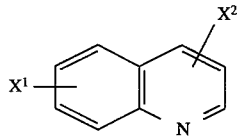
(IId)

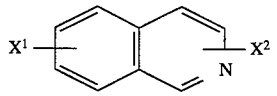
(IIe)

wherein $X^1$, $X^2$, $X^3$ and $X^4$ independently of one another are each hydrogen or $C_1$–$C_6$-alkyl and $X_5$ is hydrogen, carboxyl, carbamoyl or $C_1$–$C_4$-alkoxycarbonyl.

6. The electrostatic toner as claimed in claim 5, wherein said group R is a member selected from the group consisting of carboxymethyl, 2-carboxyethyl, 2- or 3-carboxypropyl, 2- or 4-carboxybutyl, 2-hydroxyethyl, 2- or 3-hydroxypropyl, 2- or 4-hydroxybutyl, 2-methoxyethyl, 2ethoxyethyl, 2-propoxyethyl, 2-isopropoxyethyl, 2-butoxyethyl, 2- or 3-methoxypropyl, 2- or 3-ethoxypropyl, 2- or 3-propoxypropyl, 2- or 3-butoxypropyl, 2- or 4-methoxybutyl, 2- or 4-ethoxybutyl, 2- or 4-propoxybutyl, 2- or 4-butoxybutyl, methoxycarbonylmethyl, ethoxycarbonylmethyl, 2-methoxycarbonylethyl, 2-ethoxycarbonylethyl, 2- or 3-methoxycarbonylpropyl, 2- or 3-ethoxycarbonylpropyl, 2- or 4-methoxycarbonylbutyl, 2- or 4-ethoxycarbonylbutyl, 2-, 3- or 4-methylphenyl, 2,4-dimethylphenyl, 2-, 3- or 4-methoxyphenyl, 2,4-dimethoxyphenyl, 2-, 3- or 4-hydroxyphenyl, 2,4-dihydroxyphenyl, 2-, 3- or 4-chlorophenyl, 2,4-dichlorophenyl, methoxy, ethoxy, propoxy, isopropoxy, butoxy, isobutoxy, sec-butoxy, phenoxy, 2-, 3- or 4-methylphenoxy, 2,4-dimethylphenoxy, 2-, 3- or 4-methoxyphenoxy, 2,4-dimethoxyphenoxy, 2-, 3- or 4-hydroxyphenoxy, 2,4-dihydroxyphenoxy, 2-, 3- or 4-chlorophenoxy, 2,4-dichlorophenoxy, mono- or dimethylamino, mono- or diethylamino, mono- or dipropylamino, mono- or diisopropylamino, mono- or dibutylamino, mono- or diphenylamino, mono- or bis(4-chlorophenyl)amino or N-methyl-N-phenylamino.

7. An electrostatic toner as claimed in claim 5, wherein substituent $X^5$ is methoxycarbonyl, ethoxycarbonyl, propoxycarbonyl, isopropoxycarbonyl or butoxycarbonyl.

8. An electrostatic toner as claimed in claim 1, wherein anion $An^{\ominus}$ is halide, sulfate, bisulfate, methanesulfonate, trifluoromethanesulfonate, 2-hydroxyethanesulfonate, tetraphenylborate, tetrafluoroborate, p-toluenesulfonate, nitrate, perchlorate, 1-hydroxyethane-1,1-diphosphonate, phosphate, hydrogen phosphate, dihydrogen phosphate, formate, acetate, oxalate, citrate or tartrate.

9. An electrostatic toner as claimed in claim 1, containing from 0.01 to 10% by weight, based on the weight of the toner, of a compound of the formula I.

10. A method of preparing an electrostatic toner, comprising:

incorporating, in a polymeric binder, the charge stabilizer compound of claim 1.

* * * * *